United States Patent [19]

Bergström

[11] Patent Number: 4,582,113

[45] Date of Patent: Apr. 15, 1986

[54] DEVICE FOR VIBRATION AND REALIZING COMPACTION PRESSURE

[76] Inventor: Nils G. H. Bergström, Mossvägen 10, S-302 56 Halmstad, Sweden

[21] Appl. No.: 518,276

[22] Filed: Jul. 28, 1983

[30] Foreign Application Priority Data

Aug. 9, 1982 [SE] Sweden ..... 8204623

[51] Int. Cl.[4] ..... B22C 15/14

[52] U.S. Cl. ..... 164/206

[58] Field of Search ..... 164/206, 196, 197, 223, 164/203

[56] References Cited

U.S. PATENT DOCUMENTS 2,624,084 1/1953 Row ..... 164/196 X 2,652,607 9/1953 Young ..... 164/197

3,815,662 6/1974 Miller et al. ..... 164/203

*Primary Examiner*—Nicholas P. Godici

*Attorney, Agent, or Firm*—Beveridge, DeGrandi & Weilacher

[57] ABSTRACT

A device for vibration and realization of compaction pressure suitable for manufacture of sand casting molds in a flask which comprises two plates of which one plate carries a cylinder wall and forms a cylinder top and the other plate forms a piston, the space between these plates being substantially of the same diameter of the plate which forms the piston and being connected to a steplessly variable pressure medium source so that the compaction pressure and vibration amplitude are steplessly adjustable.

4 Claims, 3 Drawing Figures

DEVICE FOR VIBRATION AND REALIZING COMPACTION PRESSURE

The present invention relates to a device for vibration and the realisation of compaction pressure primarily for the manufacture of sand casting moulds in a flask.

BACKGROUND OF THE INVENTION

Prior art machinery for vibration and pressure moulding exhibit an extraordinarily complicated design, with a multiplicity of hydraulic or pneumatic piston and cylinder assemblies both to achieve compaction pressure and to realise the desired vibration. Their mechanics are complicated and consequently give rise to unreliable operation with frequent down-time and subsequent repairs. The complex mechanical construction of these prior art devices also entails relatively high manufacturing costs. Neither do the prior art constructions allow for the use of any pressure medium other than hydraulic oil in cases where it is necessary to create high compaction pressure, greater than approx. 50 tons.

SUMMARY OF THE INVENTION

One object of the present invention is to realise a device of simple construction and possessing the capability to operate with pneumatic mediums.

This is attained according to the present invention in that a first plate is provided with an edge surface for cooperation with a cylinder wall which, at the top, is provided with a second plate forming a vibration and/or compaction table; that the space formed between the plates and the cylinder wall is of the same diameter as that of the first plate, which, in its turn is smaller than the second plate, the space being in communication with a pressure medium source by the intermediary of a valve arrangement for both vibration and compaction. The second plate displays a piston wall of considerably smaller diameter than the first-mentioned cylinder wall; that the piston wall extends through the first plate and is, in the proximity of the underface of the second plate, in communication with the above-mentioned space; and that the communication is coupled to the pressure medium source by the intermediary of the cylinder arrangement. The piston wall has a portion possessing substantially the same diameter as a corresponding hole in the first plate and a length which corresponds to the desired lifting height of the second plate. Furthermore, the piston wall is provided, after the above-mentioned portion, with a further portion of lesser diameter than the hole in the first plate for realising pressure relief in the event that the desired lifting height be exceeded.

As a result of the present invention, a device for vibration and the generation of compaction pressure will be of extremely simple construction which is thereby considerably more reliable from the point of view of operation than prior art constructions. The present invention also makes possible the utilization of a per se conventional compaction pressure source of the type which is available on most plants for the manufacture of sand casting moulds. Thus, a device according to the present invention may be powered pneumatically in its entirety.

BRIEF DESCRIPTION OF THE DRAWINGS

The nature of the present invention and its aspects will be more readily understood from the following brief description of the accompanying Drawings, and discussion relating thereto. In the accompanying Drawings.

DESCRIPTION OF PREFERRED EMBODIMENT

Figure 1:
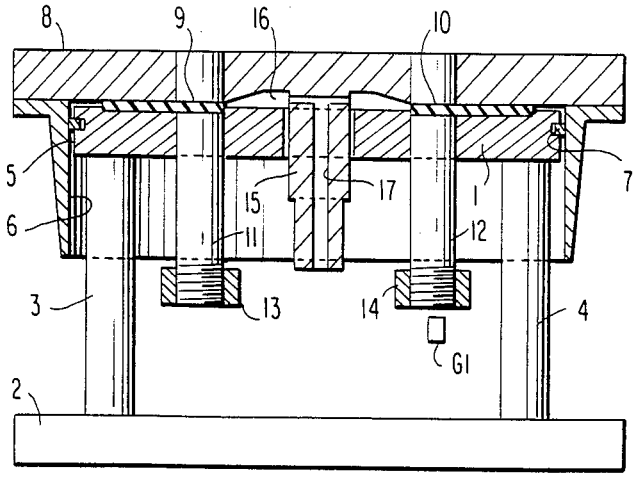
FIG. 1 is a schematic side elevation, partly in section, through one embodiment of a device according to the present invention.

The embodiment of a device according to the present invention illustrated in FIG. 1 is shown merely in principle and consists of a piston plate 1 which is placed on a base 2 with supports 3 and 4. The base 2 may consist of a plate or a number of joists or beams which are arranged to cooperate with a number of supports 3 and a number of supports 4, the joists and supporrts being arranged to form as stable a substrate for the piston plate 1 as possible. The supports and, possibly, the joists may be replaced by walls. The piston plate 1 is circular and has an edge surface 5 intended for cooperation with the inner face of the cylinder wall 6. To this end, the edge surface 5 is provided with a suitable cylinder gasket 7 which may be of any optional, suitable type. The cylinder face 6 has a cylinder top which forms a vibration table plate 8. Between the piston plate 1 and the vibration table plate 8, which also serves as a compaction plate, there are disposed shock-absorbing members 9 and 10. These shock-absorbing members may consists of rods, plates or rings of resiliently yieldable material, for example rubber. The plate 8 is, furthermore, provided with at least two rods 11 and 12 which are fixedly retained in the plate 8 and extend through holes in the plate 1, and, at that end in facing relationship to the plate 8, are provided with stopping members 13 and 14. These stopping members 13 and 14 may consist of nuts threaded on the ends of the rods 11 and 12. These nuts ensure that the cylinder face 6 cannot rise above the plate 1.

Furthermore, there is provided on the plate 8 a piston wall 15 which extends through a corresponding hole in the plate 1. The fit between the hole in the plate 1 and the piston wall 15 is preferably of the order of magnitude of a few hundredths of a millimeter. At the end of the piston wall 15, turned in relation to the plate 8, the wall is of smaller diameter than the hole in the plate 1, whereby the space 16 formed between the plates 1 and 8 and the cylinder face 6 will be relieved of the pressure medium prevailing therein when the piston wall 15 of larger diameter leaves the hole in the plate 1. Within the section formed by the piston wall 15, there is provided a duct 17 which, at the portion most proximal the plate 8, is in open communication with the space 16 and whose opposite end is connected to a pressure medium source by the intermediary of a valve arrangement of the type illustrated in FIG. 2.

In the present case, the pressure medium source is a pneumatic medium, for example, compressed air, at a pressure of, for example, 18 atp. If the diameter of the space 16 is 800 mm, the compaction pressure attainable in the device illustrated in FIG. 1 will amount to approx. 90 tons, and if the diameter of the space 16 is increased by 200 mm, the pressure attainable with 18 atp will be approx. 140 ton. A further increase of the diameter by 200 mm will give a compaction pressure of approx. 200 tons with the same pressure medium source.

The pressure in the pressure medium source is steplessly adjustable from, for example, 0 to 18 atp by means of a per se known pressure regulator whereby the compaction pressure may also be varied from 0 to maximum.

Apart from providing considerable pressure, the device illustrated in FIG. 1 may also be utilised for realising vibration. In this case, there is disposed, at the end of one of the rods, for example 12, a vibration amplitude transducer G1 which in its turn is connected to an electronics unit for controlling the valve arrangement illustrated in FIG. 2.

Figure 2:
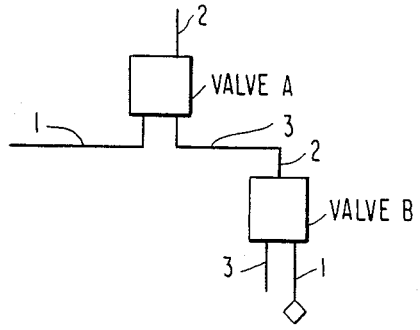
FIG. 2 is a diagram of a valve arrangement of the device according to the present invention illustrated in FIG. 1.
Figure 3:
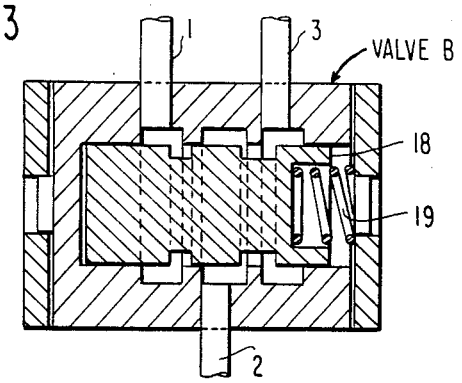
FIG. 3 is a schematic cross-section through one of the valves in the arrangement according to FIG. 2.

The valve arrangement illustrated in FIG. 2 consists of one valve A and one valve B. The valve A is a solenoid valve for feeding compressed air from the port 1 to the port 2, the port 2 being in communication with the duct 17 and, by this intermediary, with the space 16. The port 3 in valve A is, furthermore, in communication with the port 2 in valve B which is also a solenoid valve whose construction is illustrated in greater detail in FIG. 3. Whilst the valve A is a standard on-off valve for the contemplated pressure of the pressure medium, the valve B is a short-stroke valve for large volumes. The valve B essentially serves to realise the vibration motion of the plate 8. The port 1 in valve B is connected to a pressure medium source, whereas the port 3 is an air bleeder and the port 2 is connected to the space 16 by the intermediary of ports 3 and 2 in valve A when this is in its off position. As will be apparent to the skilled reader of FIG. 3, the valve B consists of a piston 18 which, by means of a spring 19, is urged to the left, in which event the output port 3 will be in communication with the atmosphere, like the output port 2. If the valve B is impressed with an electric impulse from the electronics circuit, the piston 18 will be switched to the right against the action of the spring 19, whereby the port 3 will be closed and the port 1 will be placed in communication with the port 2, so that pressure medium may be fed via the port 2 and ports 3 and 2 in valve A, the piston 18 being returned by the action of the spring 19 to the position illustrated in FIG. 3 as soon as the electric impulse is discontinued. The length of the electric impulse may, thus, correspond to the amplitude of the vibration motion. The amplitude transducer G1 is preferably of such type as to permit a maximum motion of 2 mm of the rod 12 before cutting off the impulse to the valve B and the associated electronics circuit further includes time-lag means which may be adjustable within a time period of from 0.01 to 0.5 sec., giving a steplessly adjustable vibration or motion amplitude from the above-disclosed 2 mm and upwards.

I claim:

1. A device for vibration and realisation of compaction pressure, suitable for the manufacture of sand casting moulds in a flask, comprising a first plate (1) provided with an edge surface (5) for cooperation with a cylinder face (6), of an outer cylinder wall, said cylinder face (6) being on the inside of said wall which is directed downwardly and is open, at its bottom said the length of edge surface (5) being substantially less than the length of said cylinder face (6), said cylinder face (6) being provided, at its top, with a second plate (8) which forms a vibration and/or compaction table, there being a space (16) formed between said plates (1, 8), the space between said plate and said cylinder face (6) being of the same diameter as said first plate (1), which, in its turn, is smaller than said second plate (8), and is connected to a pressure medium source by valve means for both vibration and compaction, said second plate being capable of being elevated relative to said first plate.

2. The device according to claim 1, further comprising said second plate (8) is provided with a piston wall (15) of considerably lesser diameter than said cylinder wall (6), wherein the piston wall (15) extends through said first plate (1) and is, in the proximity of the underface of said second plate (8), in communication with said space (16), defined by said first and second plates and wherein said communication (17) is coupled to said pressure medium source by said valve means.

3. The device according to claim 3, further comprising said piston wall (15) having a portion of substantially the same diameter as a corresponding hole in said first plate (1) and a length which corresponds to the desired fitting height of said second plate (8).

4. The device according to claim 3, further comprising said piston wall (15) is provided, after said portion, with a further portion of lesser diameter than the hole in said first plate (1) for realising a pressure relief in the event that the desired lifting height be exceeded.

* * * * *